United States Patent [19]

Yamagishi et al.

[11] 4,052,234

[45] Oct. 4, 1977

[54] METHOD FOR CONTINUOUSLY QUENCHING ELECTROLYTIC TIN-PLATED STEEL STRIP

[75] Inventors: Hidehisa Yamagishi; Mizuo Tanaka; Riichi Shiono, all of Yokohama, Japan

[73] Assignee: Nippon Kokan Kabushiki Kaisha, Tokyo, Japan

[21] Appl. No.: 620,310

[22] Filed: Oct. 7, 1975

Related U.S. Application Data

[63] Continuation-in-part of Ser. No. 517,449, Oct. 24, 1974, abandoned.

[30] Foreign Application Priority Data

Nov. 5, 1973 Japan ..... 48-123361
Nov. 6, 1973 Japan ..... 48-124020

[51] Int. Cl.[2] ..... C21D 9/52; C25D 5/50

[52] U.S. Cl. ..... 148/156; 148/157; 204/37 T

[58] Field of Search ..... 148/153, 156, 155, 143, 148/157; 204/36, 37 T

[56] References Cited

U.S. PATENT DOCUMENTS 3,410,734 11/1968 Taylor ..... 148/153

*Primary Examiner*—R. Dean
*Attorney, Agent, or Firm*—Flynn & Frishauf

[57] ABSTRACT

In order to brighten the surface of a tin-plated layer of steel strip tin-plated on a commonly known continuous electrolytic tin-plating line, said strip is heated in a traditional continuous heating furnace for rapid fusion of its tin-plated layer, and then promptly quenched for solidification. In doing so, said quenching is carried out in two stages aiming at obtaining an excellent corrosion resistance as well as preventing the occurrence of quench stains. In other words, a relatively low-rate quenching in the initial stage is carried out by spraying a quenching liquid mist or a stream of high-pressure quenching liquid onto both sides of said strip across the entire width, uniformly on the same horizontal level, in the air above the surface of quenching liquid in a quenching tank immediately following said heating furnace, before said strip comes into the quencing liquid in said quenching tank. Then, a relatively high-rate quenching in the second stage is carried out for said strip having come into the quenching liquid in said quenching tank by spraying quenching liquid of a high-pressure and in a large quantity onto both sides of said strip across the entire width, uniformly on the same horizontal level, beneath the surface of quenching liquid in said quenching tank.

10 Claims, 5 Drawing Figures

METHOD FOR CONTINUOUSLY QUENCHING ELECTROLYTIC TIN-PLATED STEEL STRIP

RELATED APPLICATION

This application is a continuation-in-part of application Ser. No. 517,449, filed Oct. 24, 1974 abandoned.

FIELD OF THE INVENTION

This invention relates to a method and apparatus for continuously quenching a continuously electrolytic tin-plated steel strip to prevent the occurrence of stains on the surface of its tin-plated layer at the time of continuously heating and quenching said steel strip in moving, to brighten its tin-plated layer.

BACKGROUND OF THE INVENTION

The surface of plated layer of a tin-plated steel strip produced by a commonly known continuous electrolytic tin-plating method is dull, and has no gloss. For the purpose of giving gloss to the surface of thus tin-plated layer, the method traditionally applied comprises heating said strip in a continuous heating furnace to cause rapid fusion of said tin-plated layer, and then immediately directing said strip into a quenching tank to quench it for solidification of the tin-plated layer.

If the quenching is improperly applied, however, dirt patterns which look like dried stains of dirty water (hereinafter referred to as "quench stain") are produced on the surface of tin-plated layer of the strip, considerably reducing the commercial value of the strip. Said quench stain is produced by an unevenly quenched tin-plated layer due to an irregular quenching rate caused by the non-uniform contact between the strip and the quenching liquid, which is brought about by surface turbulence of the quenching liquid in the quenching tank on introducing the strip into it, splashes of quenching liquid onto the strip, and uneven deposit of a steam film, which is generated by quenching, on the strip.

Also, said tin-plated layer of the strip produces an alloy layer of tin and iron at its fusion, and it is necessary to make it a uniform and dense alloy layer for obtaining an excellent corrosion resistance. For this purpose, there should be a certain duration of time sufficient to cause progressive development of the alloy layer. In other words, slowing down of the quenching rate of the strip is required to a certain degree. On the other hand, however, increasing the quenching rate is required for accelerating the quenching line operation.

In order to solve these problems, there have been a number of proposals. In a method disclosed in U.S. Pat. No. 3,358,980, for instance, two compartments with a hood and spaced plates are installed in a quenching tank, and surface turbulence on the surface of quenching liquid in the quenching tank caused by the incoming strip is prevented with the use of said spaced plates. Besides, a narrow region is confined by said spaced plates. The heated strip is directed into this narrow region. The quenching liquid first fed into said compartments flows down into the quenching tank by gravity along the both sides of the strip, in the same direction as the travel of the strip, and almost in parallel with the strip, in said narrow region, and after filling up the quenching tank, the quenching liquid overflows. Initially, the strip, brought into contact with the quenching liquid in said narrow region, is quenched at a relatively slow quenching rate, and secondly is moved into the quenching tank, being quenched down to a prescribed temperature. Further, a temperature sensing device is provided in said narrow region to control the quenching liquid temperature.

According to the above-mentioned method, no surface turblence is produced on the surface of the quenching liquid in the quenching tank on introducing the strip into it, so that the tin-plated layer is quenched uniformly, permitting prevention of quench stains. However, in this method, because the quenching liquid comes into contact with the strip while flowing down in said narrow region by gravity, the impact of the quenching liquid against the strip is small. Nevertheless, with the recent speeding-up of a continuous electrolytic tin-plating line, the moving speed of strip has been accelerated up to some 300–450 m/min. Accordingly, quenching capacity obtained only by a stream of quenching liquid by gravity as is the case of this method is insufficient. With an insufficient quenching capacity, steam generating at the interface between the strip and the quenching liquid accompanies the strip, being deposited on the surface of the strip. As a result, irregularity is found in the quenching rate of the tin-plated layer, which is not uniformly quenched, so that it is impossible to completely prevent the occurrence of quench stains. In other words, this method is not applicable to a high-speed continuous electrolytic tin-plating line. Besides, it is necessary to provide the quenching tank with a hood, spaced plates and compartments, leading to increased costs of quenching facilities.

Further, in a method disclosed in U.S. Pat. No. 3,410.734, an elongated conduit section of rectangular cross-section which provides a restricted quench channel extends upwardly from a quenching tank. A quenching liquid supplied into the quenching tank, after filling up the quenching tank, comes up in said restricted quench channel and flows over its upper end into a trough. Closely adjacent the upper end of said restricted quench channel, a plurality of submerged jet or spray units are provided for directing streams of quenching liquid toward a strip across the entire width thereof. A heated steel strip moves downwardly from a heating furnace and enters the restricted quench channel where it is immediately immersed in the upwardly flowing stream of quenching liquid. In addition, the submerged jet or spray units direct streams of quenching liquid against the strip in a direction generally normal to the strip. Said submerged jet or spray units use a large quantity of quenching liquid with a relatively low pressure of about 1.4 – 2.1 kg/cm$^2$.

According to the above-mentioned method, the strip can be quenched over the entire width uniformly and at a high rate. Therefore, this method is applicable, in particular, for obtaining strips having martensitic microstructure and superior in flatness. However, this method has no special regard for the prevention of quench stains and for the achievement of an excellent corrosion resistance. Particularly, no regard is paid to such points as developing in the tin-plated layer an alloy layer necessary for obtaining an excellent corrosion resistance, in other words, making the quenching rate in the initial stage of quenching relatively slower. The method has another disadvantage of requiring a complicated quenching device which increases the installation costs.

There is also known a method to fuse electrolytically deposited tin in a heating furnace aiming at improving the corrosion resistance on either the upper or under surface of a continuously electrolytic tin-plated steel strip, then to spray quenching liquid on either the upper or under surface of the strip, in the air or beneath the surface of the quenching liquid in the quenching tank, and, by quenching while holding a temperature differential between both sides, to coarsen the grain size of tin on one side of the strip.

The method, though better in the slow quenching in the initial stage of quenching, has no regard to unfirom quenching of the strip over the entire width and quenching capacity. That is, in this method, increasing the pressure or the volume of water of submerged spray in the quenching tank in an attempt to improve the quenching capacity brings more serious surface turbulence of quenching liquid in the quenching tank without permitting uniform quenching of the strip over the entire width, resulting in the impossibility of preventing the production of quench stains. Moreover, quenching in the air by this method aims merely at controlling tin crystal, with no regard to uniform quenching of the strip over the entire width.

As described above, it is desired to obtain continuously electrolytic tin-plated steel strip excellent in corrosion resistance as well as glossy and with no quench stain, but a method and apparatus to obtain strip with these properties have not as yet been proposed.

SUMMARY OF THE INVENTION

Therefore, it is the main object of this invention to provide a method and apparatus of continuously quenching a continuously electrolytic tin-plated steel strip for preventing the production of quench stains on the surface of a tin-plated layer of said steel strip, eliminating the above-mentioned disadvantages of the conventional methods and devices.

Another object of this invention is to provide a method and apparatus of continuously quenching a continuously electrolytic tin-plated steel strip for giving an excellent corrosion resistance to said steel strip.

This invention is characterized by the following features: before a continuously electrolytic tin-plated steel strip with its tin-plated layer fused in a continuous heating furnace enters the quenching liquid in a quenching tank, quenching liquid mist or a stream of high-pressure quenching liquid is sprayed on both sides of said strip across the entire width, uniformly on the same horizontal level, quenching said strip at a relatively low rate in the air above the surface of the quenching liquid in said quenching tank; then, beneath the surface of the quenching liquid in said quenching tank, a large quantity of high-pressure quenching liquid spray is applied to said strip entering the quenching liquid in said quenching tank on both sides across the entire width uniformly on the same horizontal level, quenching said strip at a relatively high rate.

BRIEF DESCRIPTION OF THE DRAWINGS

Of the attached drawings.

DETAILED DESCRIPTION OF PREFERRED EMBODIMENTS

Figure 1:
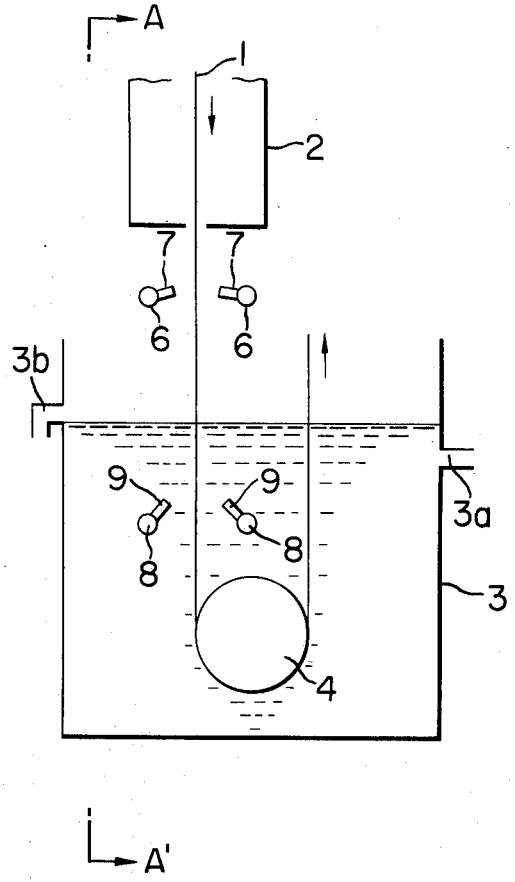
FIG. 1 is a normal sectional sketch showing an example of devices usable for putting the method of this invention into practice.

In order to give gloss to the tin-plated layer of a continuously electrolytic tin-plated steel strip, as mentioned above, said strip is usually heated in a continuous heating furnace to fuse the tin-plated layer rapidly, and by quenching said strip immediately after that, the tin-plated layer is solidified. Unless the strip is quenched uniformly over the entire width, the tin-plated layer is not quenched uniformly, causing the occurrence of quench stains on the surface of the tin-plated layer. These quench stains are produced in the initial stage of the above-mentioned quenching. Corrosion resistance of a continuously electrolytic tin-plated steel strip, on the other hand, improves by achieving a uniform and dense alloy layer of iron and tin in the tin-plated layer produced on heating the strip and fusing the tin-plated layer. For the purpose of achieving an excellent corrosion resistance, therefore, it is desirable to slow down the quenching rate of said strip in the initial stage of quenching, to cause progressive development of the alloy layer.

In this invention, taking notice of the fact described above, the first-step quenching at a relatively low rate is carried out, in the initial stage of quenching after fusing the tin-plated layer of a continuously electrolytic tin-plated steel strip in a continuous heating furnace, and then in the later stage of quenching, the second-step quenching at a relatively high rate is carried out.

In this invention, a plurality of spray nozzles are respectively installed on the same horizontal level above the surface of quenching liquid in a quenching tank which is installed below said continuous heating furnace, against both sides of said incoming strip. The above-described first-step quenching at a relatively low rate is carried out in the following way, wherein prior to said strip with its tin-plated layer fused by the continuous heating furnace moves almost vertically downward into the quenching liquid in said quenching tank, a quenching liquid mist or a stream of high-pressure quenching liquid is sprayed through said spray nozzles on both sides of said strip across the entire width, uniformly on the same horizontal level, in the air above the surface of quenching liquid in said quenching tank. In the above-mentioned spray, when using the mist, the quenching liquid is sprayed in a quantity of from 0.002 to 0.08 liter per square meter of strip per minute, and when using the stream of high-pressure, the quenching liquid is sprayed in a quantity of from 0.2 to 0.8 liter per square meter of strip per minute, to provide a quenching rate of from 500° to 900° C. per second in both cases.

Also, in this invention, a plurality of submerged nozzles are respectively installed on the same horizontal level beneath the surface of quenching liquid in said quenching tank, against both sides of said incoming strip. Said second-step quenching at a relatively high rate is carried out by spraying a relatively large quantity of high-pressure quenching liquid through said submerged nozzles on both sides of said strip across the entire width, uniformly on the same horizontal level, beneath said surface in said quenching tank when the strip which has undergone said first-step quenching enters the quenching liquid in said quenching tank. The quenching liquid is sprayed in a quantity of at least 1.2 liter per square meter of strip per minute to provide a quench rate of from 1,000° to 1,300° C. per second.

In this invention, any of water, oil and other liquid quenching media is used as a quenching liquid, but water is practical. To obtain a good result, high-pressure quenching liquid having a pressure of 2 – 20 kg/cm² in the high-pressure quenching liquid supply tube is recommended for said first-step quenching and said second-step quenching.

As mentioned above, quench stains are attributable to the non-uniform quenching in the initial stage of quenching, which is brought about by, for instance, surface turbulence of quenching liquid in the quenching tank caused by the entering strip, splash of quenching liquid on the strip, and the unevenly deposited steam film on the strip. In the first-step quenching of this invention, however, because both sides of the strip are quenched uniformly over the entire width on the same horizontal level with uniform quenching obtained in the initial stage, the production of quench stains is completely prevented. Also, the lower quenching rate in the first-step quenching does not impair the development of an alloy layer in the tin-plated layer, making it possible to obtain an excellent corrosion resistance.

Further particulars about this invention are given below, based on some examples, by reference to drawings. However, this invention shall not be restricted by these examples.

EXAMPLE 1

Figure 2:
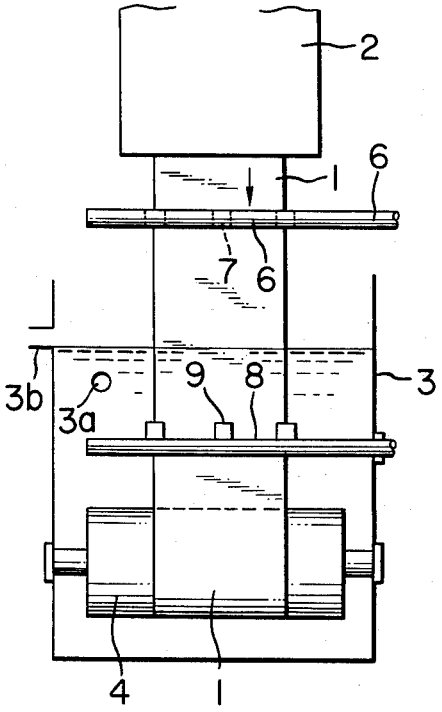
FIG. 2 is a sectional sketch along line A—A' of FIG. 1.
Figure 3:
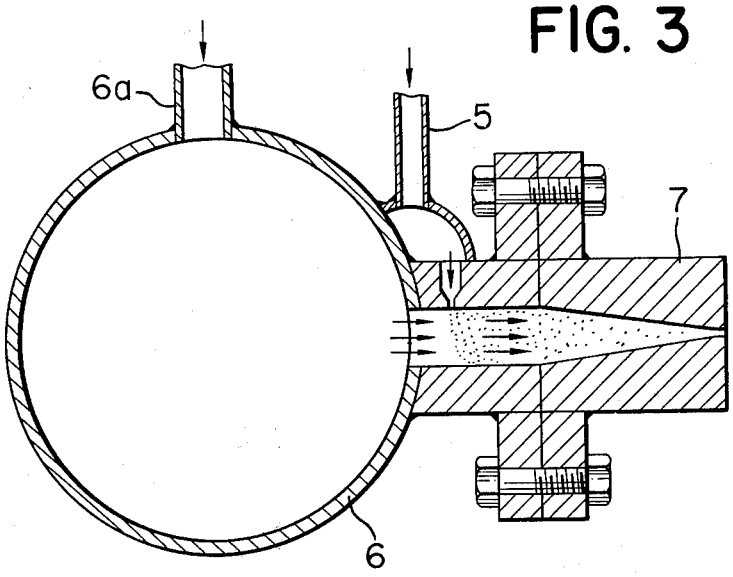
FIG. 3 is a sectional view showing an example of nozzles to pulverize and spray quenching liquid.

EXAMPLE 1 is an example in which the above-mentioned first-step quenching is carried out with quenching liquid mist; and FIGS. 1, 2 and 3 are its sketches. In FIGS. 1, 2 and 3, 1 represents a continuously electrolytic tin-plated steel strip which moves in the direction of the nearby arrow; 2 indicates a continuous heating furnace; and 3, a quenching tank comprising an entry 3*a* and an exit 3*b* for quenching liquid. Quenching liquid is supplied through the entry 3*a* and quenching liquid having filled the quenching tank 3 flows over the exit 3*b*. 4 is a sinker roll supported by watertight bearings on the quenching tank 3. 5 (FIG. 3) stands for a tube supplying quenching liquid to be pulverized into mist, and 6, a compressed-air reservoir comprising a compressed-air blowing tube 6*a* (FIG. 3). 7 represents a spray nozzle to spray quenching liquid mist. As shown in FIG. 3, compressed-air is sent through the compressed-air blowing tube 6*a* to the compressed-air reservoir 6. On the other hand, quenching liquid is supplied through the quenching liquid supply tube 5 to the spray nozzle 7. Quenching liquid is finely pulverized by compressed-air in the spray nozzle 7, and quenching liquid mist takes the form of a high-speed jet stream under the pressure of compressed-air to be sprayed by the spray nozzle 7. A plurality of spray nozzles 7 are respectively installed on the pair of compressed-air reservoirs 6, on both sides of the strip 1, on the same horizontal level above the surface of quenching liquid in the quenching tank 3, to form an angle within the range between a right angle (90°) and 45° in an upward direction against the strip 1 which moves nearly vertically. FIG. 2 shows an example of three spray nozzles 7 installed on one side. The number of spray nozzles 7 can be properly chosen so as to spray quenching liquid mist uniformly onto both sides of the strip 1 across the entire width. 8 is a submerged high-pressure quenching liquid supply tube to a submerged nozzle 9 spraying high-pressure quenching liquid. A plurality of submerged nozzles 9 are respectively installed on the pair of high-pressure quenching liquid supply tubes 8 on both sides of the strip 1, on the same horizontal level beneath the surface of quenching liquid in the quenching tank 3, to form an angle within the range between a right angle and 45° in an upward direction against the strip 1 which moves nearly vertically. The number of submerged nozzles can be properly chosen as is the case of spray nozzles 7.

Now, the continuously electrolytic tin-plated steel strip 1, after its tin-plated layer has been fused by heating in the continuous heating furnace 2 at about 240° C. — about 300° C., descends nearly vertically and the first-step quenching at a relatively low rate, i.e., quenching in the initial stage, is applied to the strip 1 with quenching liquid mist to be sprayed through spray nozzles 7, in the air above the surface of quenching liquid in the quenching tank 3. Spray nozzles 7, as mentioned above, are installed in both sides of the strip 1 on the same horizontal level, so that very finely pulverized quenching liquid is sprayed onto both sides of the strip 1 uniformly across the entire width on the same horizontal level, and both sides of the strip 1 are uniformly quenched over the entire width without unevenness in the initial stage quenching, thus permitting complete prevention of the production of quench stains. Also, as the quenching is done in the air, the quenching rate is relatively low, never hindering the development of an alloy layer in the tin-plated layer. As a result, it is possible to obtain an excellent corrosion resistance.

The, the strip 1 immediately enters quenching liquid in the quenching tank 3, and is quenched to a prescribed temperature at a high quenching rate by the application of the second-step quenching, namely, the final quenching, beneath the surface of the quenching liquid in the quenching tank 3, a high-pressure and larger quantity liquid being sprayed out from submerged nozzles 9. Then, the strip 1, moving outside the quenching tank 3 after passing around the sinker roll 4, is sent to the following process. It has been confirmed that 2 – 20 kg/cm², preferably 4 – 10 kg/cm², pressure of said high-pressure and large quantity quenching liquid in the submerged high-pressure quenching liquid supply tube 8 brings about a good result. As described above, submerged nozzles 9 are installed on both sides of the strip 1 on the same horizontal level. In the second-step quenching, therefore, the strip 1 comes in contact with high-pressure and large quantity quenching liquid to be sprayed through submerged nozzles 9 in addition to quenching liquid in the quenching tank 3. Accordingly, the strip 1 is quenched at a high quenching rate to permit high-speed operation of the quenching line. Moreover, because it is after the first-step quenching, namely, quenching in the initial stage, when quench stains are produced, acceleration of quenching rate does not threaten with quench stain production and adverse effects on the corrosion resistance. It is possible to further increase the quenching effect by adjusting quenching liquid mist to be sprayed from spray nozzles 7 lower in temperature than submerbed high-pressure quenching liquid to be sprayed from submerged nozzles 9, as the case requires.

EXAMPLE 2

Figure 4:
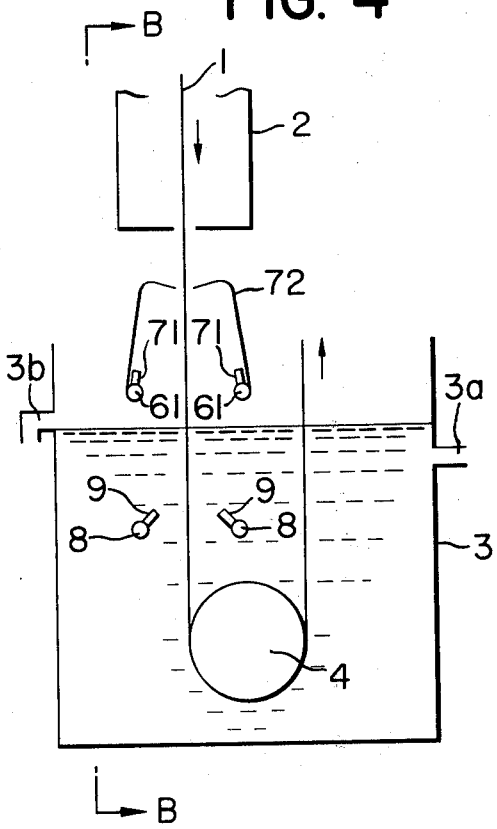
FIG. 4 is a normal sectional sketch showing another example of devices usable for putting the method of this invention into practice.
Figure 5:
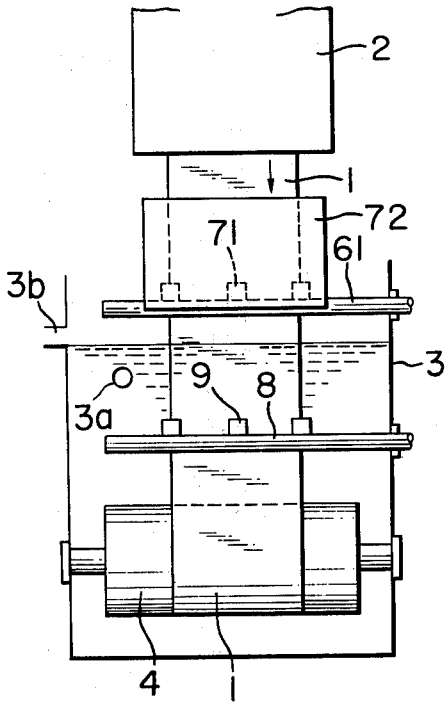
FIG. 5 is a sectional view along line B—B' of FIG. 4.

EXAMPLE 2 is an example in which the above-mentioned first-step quenching is done with high-pressure quenching liquid, FIGS. 4 and 5 being its sketches. EXAMPLE 2 is the same as EXAMPLE 1, except for the first-step quenching with quenching liquid mist in EXAMPLE 1 replaced by the first-step quenching with high-pressure quenching liquid. The following explanation centers around points different from EXAMPLE 1.

In FIGS. 4 and 5, 61 is a high-pressure quenching liquid supply tube, and 71, a spray nozzle to spray high-pressure quenching liquid. A plurality of spray nozzles 71 are respectively installed on the pair of high-pressure quenching liquid supply tubes 61, on both sides of the strip 1, on the same horizontal level above the surface of quenching liquid in the quenching tank 3, to form and angle within the range between an upwardly directed parallel position and 45° in an upward direction relative to the strip 1 which moves nearly vertically. FIG. 5 shows an example of three spray nozzles 71 installed on one side, and the number of spray nozzles 71 can be properly chosen so as to spray high-pressure quenching liquid uniformly onto both sides of the strip 1 across the entire width. It has been confirmed that 2 – 20 kg/cm$^2$ pressure of said high-pressure quenching in the high-pressure quenching liquid supply tube 61 brings about a good result. 72 is a guide plate for said high-pressure quenching liquid sprayed through spray nozzles 71. The guide plate 72, as illustrated in FIG. 4, has its top end curved toward the strip 1 which moves nearly vertically, and the topmost part of opposing guide plates 72 ends on the same horizontal level. The width of guide plate 72, as shown in FIG. 5, is a little wider than that of the strip 1. Further, guide plates 72 are symmetrically fixed on the high-pressure quenching liquid supply tube 61, one for each, on both sides of the strip 1.

Now, the continuously electrolytic tin-plated steel strip 1, after its tin-plated layer has been fused by heating in the continuous heating furnace 2 at about 240° C. — about 300° C., descends nearly vertically and the first-step quenching at a relatively low rate, namely, quenching in the initial stage, is applied to the strip 1 with high-pressure quenching liquid to be sprayed through spray nozzles 71, in the air above the surface of quenching liquid in the quenching tank 3. High-pressure quenching liquid is sprayed through spray nozzles 71 onto both sides of the strip 1 uniformly across the entire width on the same horizontal level, without splash directed by guide plates 72, so that the strip 1 is quenched uniformaly over the entire width without unevenness in the initial stage quenching, thus permitting complete prevention of the production of quench stains. Also, as the quenching is done in the air, the quenching rate is low, never impairing the development of an alloy layer in the tin-plated layer. As a result, it is possible to obtain an excellent corrosion resistance.

Next, the strip 1 immediately enters quenching liquid in the quenching tank 3 and undergoes the second-step quenching at a relatively high rate, namely, the final quenching, but since the quenching method and apparatus in this second-step are the same as is the case of EXAMPLE 1, their explanation is omitted. Also, the quenching effect can be further increased, as in the case of EXAMPLE 1, by adjusting the temperature of high-pressure quenching liquid to be sprayed through spray nozzles 71 to below the temperature of submerged high-pressure quenching liquid to be sprayed through submerged nozzles 9.

As mentioned above, according to the method and apparatus of this invention, it is possible, on quenching a continuously electrolytic tin-plated steel strip with its tin-plated layer fused by heating, to completely prevent the production of quench stains and give an excellent corrosion resistance as well as a beautiful gloss to the tin-plated layer of said strip. Further, there are other precious industrial advantages such as the realization of said high-speed quenching line, and simple facilities at relatively low installation costs.

What is claimed is:

1. A method of continuously quenching a continuously moving electrolytic tin-plated steel strip, comprising 1. maintaining a relatively low quenching rate of from 500° to 900° C. per second by spraying a quenching liquid mist onto a continuously moving tin-plated steel strip with its tin-plated layer fused thereto with heat, in the air above the surface of a quenching liquid maintained in a quenching tank, with a quantity of said quenching liquid of from 0.002 to 0.08 liter per square meter per minute, followed by
2. passing said strip into said quenching tank containing said quenching liquid, and
3. maintaining a relatively higher quenching rate of from 1,100° to 1,300° C. per second by spraying a larger quantity of quenching liquid of at least 1.2 liters per square meter per minute under a high pressure onto said strip beneath said surface in said quenching tank.

2. A method of continuously quenching a continuously moving electrolytic tin-plated steel strip, comprising 1. maintaining a relatively low quenching rate of from 500° to 900° C. per second by spraying a quenching liquid at high pressure along a guide plate onto a continuously moving tin-plated steel strip with its tin-plated layer fused thereto with heat, in the air above the surface of a quenching liquid maintained in a quenching tank, with a quantity of said quenching liquid of from 0.2 to 0.8 liter per square meter per minute, followed by
2. passing said strip into said quenching tank containing said quenching liquid, and
3. maintaining a relatively higher quenching rate of from 1,100° to 1,300° C. per second by spraying a larger quantity of quenching liquid of at least 1.2 liters per square meter per minute under a high pressure onto said strip beneath said surface in said quenching tank.

3. The method of claim 1, wherein said mist is so sprayed in (1) onto both sides of said strip from a plurality of spray nozzles positioned on both sides of said strip across the entire width thereof and substantially on the same horizontal level with each other.

4. The method of claim 1, wherein said liquid is so sprayed in (3) onto both sides of said strip from a plurality of spray nozzles positioned on both sides of said strip across the entire width thereof and substantially on the same horizontal level with each other.

5. The method of claim 2, wherein said liquid is so sprayed in (1) onto both sides of said strip from a plurality of spray nozzles positioned on both sides of said strip across the entire width thereof and substantially on the same horizontal level with each other.

6. The method of claim 2, wherein said liquid is so sprayed in (3) onto both sides of said strip from a plurality of spray nozzles positioned on both sides of said strip across the entire width thereof and substantially on the same horizontal level with each other.

7. The method of claim 1, wherein the quenching liquid sprayed in (3) is at a pressure between 4 kg/cm$^2$ and 10 kg/cm$^2$.

8. The method of claim 2, wherein the quenching liquid sprayed in (1) is at a pressure between 2 kg/cm$^2$ and 20 kg/cm², and in (3) is between 4 kg/cm² and 10 kg/cm².

9. A method of continuously quenching a continuously moving electrolytic tin-plated steel strip, comprising:

moving said strip in a substantially vertical direction through the atmosphere;

spraying a first quantity of a quenching liquid mist towards said strip from both sides thereof and at substantially the same horizontal level, said spraying being directed at an angle within the range between a right angle and 45° in an upward direction relative to said substantially vertically moving strip;

thereafter passing said strip in a substantially vertical direction into a quenching tank containing a quenching liquid; and then spraying a second quantity of a quenching liquid at high pressure toward said strip from both sides thereof below the surface of the quenching liquid in said quenching tank and at substantially the same horizontal level below the surface of the quenching liquid in said quenching tank, said high-pressure spraying being directed at an angle within the range between a right angle and 45° in an upward direction relative to said substantially vertically moving strip, said second quantity of quenching liquid being greater than said first quantity.

10. A method of continuously quenching a continuously moving electrolytic tin-plated steel strip, comprising:

moving said strip in a substantially vertical direction through said atmosphere between at least a pair of guide plates;

spraying a first quantity of high-pressure quenching liquid toward said strip from both sides thereof and at substantially the same horizontal level, said spraying being directed at an angle within the range between an upwardly directed parallel direction and 45° in an upward direction relative to said substantially vertically moving strip, at least a portion of said high-pressure quenching liquid spray being directed toward said guide plates;

deflecting with said guide plates said portion of said high-pressure quenching liquid spray directed thereon toward said strip, the uppermost part of said guide plates being curved toward said strip, the curved uppermost parts ending substantially at the same horizontal level;

thereafter passing said strip in a substantially vertical direction into a quenching tank containing a quenching liquid; and then spraying a second quantity of a high-pressure quenching liquid toward said strip from both sides thereof below the surface of the quenching liquid in said quenching tank and at substantially the same horizontal level below the surface of the quenching liquid in said quenching tank, said high-pressure spraying being directed at an angle within the range between a right angle and 45° in an upward direction relative to said substantially vertically moving strip, and said second quantity being greater than said first quantity.

* * * * *